US009387526B2

(12) United States Patent
Abe et al.

(10) Patent No.: US 9,387,526 B2
(45) Date of Patent: Jul. 12, 2016

(54) ROLLER LEVELER AND PLATE FLATTENING METHOD USING THE SAME

(71) Applicant: JP STEEL PLANTECH CO., Yokohama-shi (JP)

(72) Inventors: Keizo Abe, Yokohama (JP); Toru Aoyama, Yokohama (JP); Toru Sano, Yokohama (JP)

(73) Assignee: JP STEEL PLANTECH CO., Yokohama-shi (JP)

( * ) Notice: Subject to any disclaimer, the term of this patent is extended or adjusted under 35 U.S.C. 154(b) by 0 days.

(21) Appl. No.: 14/396,198

(22) PCT Filed: Apr. 8, 2013

(86) PCT No.: PCT/JP2013/060621
§ 371 (c)(1),
(2) Date: Oct. 22, 2014

(87) PCT Pub. No.: WO2013/161555
PCT Pub. Date: Oct. 31, 2013

(65) Prior Publication Data

US 2015/0128675 A1 May 14, 2015

(30) Foreign Application Priority Data

Apr. 26, 2012 (JP) ..... 2012-101004

(51) Int. Cl.
*B21B 1/24* (2006.01)
*B21B 37/28* (2006.01)
(Continued)

(52) U.S. Cl.
CPC ..... *B21B 1/24* (2013.01); *B21B 27/021* (2013.01);
(Continued)

(58) Field of Classification Search
CPC ..... B21D 1/00; B21D 1/02; B21D 1/05; B21D 17/04; B21B 1/0866; B21B 1/22–1/14; B21B 27/02; B21B 27/021; B21B 27/03; B21B 27/032; B21B 27/028; B21B 35/00; B21B 39/008; B21B 39/06; B21B 37/28; B21B 2263/04; B21B 2263/06; B21B 2261/05; B21B 2261/065; B21B 2267/02; B21B 2267/06; B21B 2267/18–2267/20; B21B 2267/22; B21B 1/086; B21B 2267/228
USPC ..... 72/160–162, 164, 165, 167, 226, 227, 72/229, 365.2, 379.2
See application file for complete search history.

(56) References Cited

U.S. PATENT DOCUMENTS 1,106,172 A * 8/1914 Wetcke ..... B21B 1/24 72/187

(Continued)

FOREIGN PATENT DOCUMENTS

JP 60-162524 A 8/1985
JP 60-170526 9/1985

(Continued)

OTHER PUBLICATIONS

International Search Report Issued Jun. 18, 2013 in PCT/JP13/060621 Filed Apr. 8, 2013.

(Continued)

*Primary Examiner* — Peter DungBa Vo
*Assistant Examiner* — Joshua D Anderson
(74) *Attorney, Agent, or Firm* — Oblon, McClelland, Maier & Neustadt, L.L.P.

(57) ABSTRACT

A roller leveler includes: a leveling roll unit having a plurality of leveling rolls configured to rotate so as to pass a plate while sandwiching and pressing the plate; a pushing cylinder provided at each of an entrance side and a discharge side of the leveling roll unit, at which the plate enters and is discharged, respectively, and configured to press the plate via the leveling rolls; and a driving mechanism configured to rotate the leveling rolls to pass the plate. At least one of the plurality of leveling rolls has a stepped structure, including a lateral center portion with a large diameter, corresponding to a center portion of the plate with respect to a plate width direction, and lateral end portions with a small diameter, corresponding to edge portions of the plate with respect to the plate width direction.

12 Claims, 5 Drawing Sheets

(51) Int. Cl.

| | |
|---|---|
| ***B21D 1/05*** | (2006.01) |
| ***B21D 1/02*** | (2006.01) |
| ***B21B 27/02*** | (2006.01) |
| ***B21B 35/00*** | (2006.01) |
| ***B21B 39/00*** | (2006.01) |
| ***B21B 39/06*** | (2006.01) |
| *B21B 27/03* | (2006.01) |

(52) U.S. Cl.

CPC ..... *B21B 35/00* (2013.01); *B21B 37/28* (2013.01); *B21B 39/008* (2013.01); *B21B 39/06* (2013.01); *B21D 1/02* (2013.01); *B21D 1/05* (2013.01); *B21B 27/032* (2013.01); *B21B 2263/06* (2013.01); *B21B 2267/06* (2013.01)

(56) References Cited

U.S. PATENT DOCUMENTS

| | | | | |
|---|---|---|---|---|
| 4,599,770 | A * | 7/1986 | Kato | B21B 27/05 492/1 |
| 7,031,797 | B2 * | 4/2006 | Reinschke | B21B 37/28 700/148 |
| 2009/0113973 | A1 * | 5/2009 | Cox, III | B21B 15/00 72/165 |

FOREIGN PATENT DOCUMENTS

| | | |
|---|---|---|
| JP | 61-037322 | 2/1986 |
| JP | 63-199024 | 8/1988 |
| JP | 3-70809 | 7/1991 |
| JP | 05-050144 | 3/1993 |
| JP | 08-047721 | 2/1996 |
| JP | 2000-246338 | 9/2000 |
| JP | 2008-173676 | 7/2008 |

OTHER PUBLICATIONS

Written Opinion of the International Searching Authority issued Jun. 18, 2013 in PCT/JP13/060621 Filed Apr. 8, 2013 (with English translation).

Combined Chinese Office Action and Search Report issued Oct. 29, 2014 in Patent Application No. 201310143061.9 (with partial English language translation).

Office Action issued Feb. 10, 2015 in Korean Patent Application No. 10-2014-7028094 (with English language translation).

Extended European Search Report issued Mar. 24, 2015 in Patent Application No. 13781765.6.

* cited by examiner

ROLLER LEVELER AND PLATE FLATTENING METHOD USING THE SAME

TECHNICAL FIELD

The present invention relates to a roller leveler for flattening a metal plate, such as a steel plate, and a plate flattening method using the same.

BACKGROUND ART

In the process of manufacturing a plate, such as a steel plate, the plate is subjected to rolling and cooling steps, in which the plate undergoes deformation, such as warping and/or waving. Accordingly, in order to remedy the deformation, such as warping and/or waving, and thereby to flatten the plate, a roller leveler is used, which includes a plurality of leveling rolls disposed on upper and lower sides in a staggered manner.

The roller leveler passes a plate to be flattened, with the upper leveling rolls being caused to penetrate between the lower leveling rolls or the lower leveling rolls being caused to penetrate between the upper leveling rolls, to repeatedly apply bending to the plate, and thereby to planarize the warping and/or waving of the plate. In general, a plurality of lower leveling rolls and a plurality of upper leveling rolls are supported by respective roll frames and flattening of a plate is performed by pushing the upper leveling rolls via pressing cylinders (hereinafter also referred to as pushing cylinders) provided both in the entrance side and the discharge side, with the lower leveling rolls fixed.

In the process of flattening a plate, the leveling rolls are driven by driving motors and, upon contact between the leveling rolls and the plate to be flattened, driving force is transmitted to the plate, which is caught between the upper and lower leveling rolls. When this is performed, the amount of penetration, or the penetration amount (hereinafter also referred to as the amount of pressing, or the pressing amount), of the upper leveling rolls by pressing cylinders is set according to various conditions, such as the thickness, material, and shape of the plate, and the diameter and roll pitch of the leveling rolls, so that required flatness is obtained.

In the meantime, the plates to be flattened, which are metal plates, such as steel plates, generally include a plate with wavy deformation, that is, edge waves, at edge portions with respect to the plate width direction. The edge waves occur due to the following three causes:

(1) Unevenness in roll gaps in a rolling step (edge portions are relatively strongly rolled);

(2) Unevenness in cooling after hot rolling; and (3) Rolling or flattening of the material, in which yield stress in edge portions with respect to the plate width direction is lower than a center portion with respect to the plate width direction.

It is considered as a problem that, when a plate with a thickness of 6 to 10 mm, in which there are edge waves, is subjected to a flattening process using a roller leveler having large-diameter rolls with a diameter of 360 mm or so, the plate is not flattened or the edge waves therein increase. Such a leveler has been used in many cases in recent years. Specifically, since the yield stress in edge portions with respect to the plate width direction is lower than that in a center portion with respect to the plate width direction, the amount of elongation is greater at the edge portions of the plate with respect to the plate width direction. For this reason, even when there is no edge wave before flattening the plate, edge waves can occur during the flattening process. If there were already the edge waves, the degree of unevenness of the edge waves would further increase. Consequently, when a roller leveler that has large-diameter rolls with a diameter of 360 mm or so, it is difficult to flatten the plate with a thickness of 6 to 10 mm, in which there are the edge waves, or the plate with a thickness of 6 to 10 mm, in which the range of variation in yield stress is greater than 50 MPa or so in the plate width direction even though there is no edge wave.

A method of flattening a plate, in which the plate is flattened while the leveling rolls are bent in the longitudinal direction, is proposed as a technology for flattening a plate with a thickness of 6 to 10 mm, in which there are edge waves that are wavy deformation in edge portions of the plate with respect to the plate width direction (see Patent Document 1 or 2, for example).

PRIOR ART DOCUMENT

Patent Document

Patent Document 1: Japanese Patent Application Publication No. S60-170526 (JP 60-170526 A)

Patent Document 2: Japanese Patent Application Publication No. S61-037322 (JP 61-037322 A)

SUMMARY OF INVENTION

Problems to be Solved by the Invention

When the leveling rolls are small-diameter rolls with a diameter of 190 to 230 mm or so, the rigidity of the leveling rolls is low and it is therefore possible to bend the leveling rolls in the longitudinal direction. However, when the leveling rolls are large-diameter rolls with a diameter of 360 mm or so, which have been used in many cases in recent years, the rigidity of the leveling rolls is high and it is therefore difficult to bend the leveling rolls, which in turn makes it difficult to use the technologies as described in Patent Documents 1 and 2, or the like.

The present invention has been made in consideration of the above circumstances. An object of the present invention is to provide a roller leveler, with which it is possible to effectively suppress the occurrence of edge waves in a metal plate, such as a steel plate, that is caused by the variation in yield stress in the plate width direction, or it is possible to effectively eliminate edge waves in the plate irrespective of the magnitude of the variation in yield stress in the plate width direction, even when the diameter of leveling rolls is large, and a plate flattening method using such a roller leveler.

Means for Solving the Problem

In order to solve the above problem, according to a first aspect of the present invention, a roller leveler for flattening a plate by passing the plate through a pass line is provided, the roller leveler including: a leveling roll unit having a plurality of leveling rolls arranged on upper and lower sides of the pass line in a staggered manner and configured to rotate so as to pass the plate while flattening the plate sandwiched therebetween; a pushing cylinder provided at each of an entrance side and a discharge side of the leveling roll unit, at which the plate enters and is discharged, respectively, and configured to press the plate via the leveling rolls; and a driving mechanism configured to rotate the leveling rolls to pass the plate, wherein at least one of the plurality of leveling rolls has a stepped structure, the at least one of the plurality of leveling rolls including a lateral center portion with a large diameter, corresponding to a center portion of the plate with respect to a plate width direction, and a lateral end portion with a small diameter, corresponding to an edge portion of the plate with respect to the plate width direction.

In the above roller leveler, a configuration may be adopted, in which the plurality of leveling rolls include a plurality of upper leveling rolls that are arranged above the pass line and a plurality of lower leveling rolls that are arranged below the pass line, wherein at least one of the lower leveling rolls has the stepped structure. In this case, it is preferable that two or more of the lower leveling rolls from one end of the leveling roll unit have the stepped structure.

A configuration may be adopted, in which the leveling roll unit includes the leveling roll or rolls having the stepped structure at one end side of the leveling roll unit, and, at the other end side of the leveling roll unit, includes the leveling roll or rolls having a straight form only, flattening of the plate is performed with the one end side being the entrance side when a variation $\Delta\sigma$ in yield stress in the plate in the plate width direction satisfies a relation, $\Delta\sigma>0.08\times\sigma_{MAX}$, and/or there are edge waves in the plate, and flattening of the plate is performed with the other end side being the entrance side when a relation, $\Delta\sigma\leq0.08\times\sigma_{MAX}$, is satisfied and there is no edge wave in the plate, wherein $\Delta\sigma$ is equal to $\sigma_{MAX}-\sigma_{MIN}$, $\sigma_{MAX}$ is the maximum value of yield stress in the plate width direction, and $\sigma_{MIN}$ is the minimum value of yield stress in the plate width direction.

A configuration may be adopted, in which length of the lateral center portion of the leveling roll having the stepped structure and length of the lateral end portion thereof are set according to width and material of the plate to be flattened, and a heat-treatment condition. A configuration may be adopted, in which the leveling roll having the stepped structure is configured so that the lateral end portion thereof is capable of being fitted with a ring having a diameter the same as that of the lateral center portion thereof so that length of the lateral center portion thereof is adjustable with the use of the ring.

According to a second aspect of the present invention, a plate flattening method of flattening a plate with the use of a roller leveler, in which the plate is passed through a pass line to flatten the plate, is provided, the roller leveler including: a leveling roll unit having a plurality of leveling rolls arranged on upper and lower sides of the pass line in a staggered manner; a pushing cylinder provided at each of an entrance side and a discharge side of the leveling roll unit, at which the plate enters and is discharged, respectively, and configured to press the plate via the leveling rolls; and a driving mechanism configured to rotate the leveling rolls to pass the plate, the plate flattening method including: sandwiching the plate between the plurality of leveling rolls; and rotating the leveling rolls while the pushing cylinder presses the plate via the leveling rolls to pass and flatten the plate, wherein at least one of the plurality of leveling rolls has a stepped structure, the at least one of the plurality of leveling rolls including a lateral center portion with a large diameter, corresponding to a center portion of the plate with respect to a plate width direction, and a lateral end portion with a small diameter, corresponding to an edge portion of the plate with respect to the plate width direction, whereby, when the plate is flattened, the pressing amount at the center portion of the plate with respect to the plate width direction is greater than the pressing amount at the edge portion of the plate with respect to the plate width direction to suppress occurrence of edge waves at the edge portion of the plate with respect to the plate width direction and/or eliminate edge waves present at the edge portion of the plate with respect to the plate width direction.

In the above plate flattening method, a configuration may be adopted, in which the plurality of leveling rolls include a plurality of upper leveling rolls that are arranged above the pass line and a plurality of lower leveling rolls that are arranged below the pass line, wherein at least one of the lower leveling rolls has the stepped structure. In this case, it is preferable that two or more of the lower leveling rolls from one end of the leveling roll unit have the stepped structure.

A configuration may be adopted, in which the leveling roll unit includes the leveling roll or rolls having the stepped structure at one end side of the leveling roll unit, and, at the other end side of the leveling roll unit, includes the leveling roll or rolls having a straight form only, when a variation $\Delta\sigma$ in yield stress in the plate in the plate width direction satisfies a relation, $\Delta\sigma>0.08\times\sigma_{MAX}$, and/or there are edge waves in the plate, flattening of the plate is performed with the one end side being the entrance side so that the pressing amount at the center portion of the plate with respect to the plate width direction is greater than the pressing amount at the edge portion of the plate with respect to the plate width direction to suppress occurrence of the edge waves at the edge portion of the plate with respect to the plate width direction and/or eliminate the edge waves present at the edge portion of the plate with respect to the plate width direction with the use of the leveling roll or rolls having the stepped structure, and, when a relation, $\Delta\sigma\leq0.08\times\sigma_{MAX}$, is satisfied and there is no edge wave in the plate, flattening of the plate is performed with the other end side being the entrance side so that the elongation of the center portion of the plate with respect to the plate width direction and the elongation of the edge portion of the plate with respect to the plate width direction are almost equal to each other, wherein $\Delta\sigma$ is equal to $\sigma_{MAX}-\sigma_{MIN}$, $\sigma_{MAX}$ is the maximum value of yield stress in the plate width direction, and $\sigma_{MIN}$ is the minimum value of yield stress in the plate width direction.

A configuration may be adopted, in which length of the lateral center portion of the leveling roll having the stepped structure and length of the lateral end portion thereof are set according to width and material of the plate to be flattened, and a heat-treatment condition. A configuration may be adopted, in which the leveling roll having the stepped structure is configured so that the lateral end portion thereof is capable of being fitted with a ring having a diameter the same as that of the lateral center portion thereof so that length of the lateral center portion thereof is adjustable with the use of the ring according to width and material of the plate to be flattened, and a heat-treatment condition.

Effects of Invention

According to the present invention, at least one of the plurality of leveling rolls has a stepped structure, the at least one of the plurality of leveling rolls including a lateral center portion with a large diameter, corresponding to a center portion of the plate with respect to a plate width direction, and a lateral end portion with a small diameter, corresponding to an edge portion of the plate with respect to the plate width direction, so that the pressing amount (penetration amount) at the center portion of the plate with respect to the plate width direction is greater than the pressing amount at the edge portion of the plate with respect to the plate width direction and the path length of flattening processing is longer at the center portion of the plate with respect to the plate width direction as compared to those at the edge portions thereof. This makes the elongation of the center portion of the plate with respect to the plate width direction relatively large. Accordingly, it is possible to increase the elongation at the center portion of the plate with respect to the plate width direction by reducing the pressing amount (penetration amount) at the edge portions of the plate with respect to the plate width direction, at which the yield stress is small and elongation is therefore easily caused, as compared to the pressing amount at the center portion of the plate with respect to the plate width direction in case that the variation in yield stress of the plate in the plate width direction is large. Thus, it is possible to suppress the occurrence of edge waves in the plate during the flattening process even when large-diameter leveling rolls having high rigidity are used. Even when edge waves have already occurred in the plate, it is possible to reduce the pressing amount (penetration amount) at the edge portions with respect to the plate width direction, at which there are edge waves, to reduce the elongation of the corresponding part of the plate P irrespective of the magnitude of the variation in yield stress, so that it is possible to eliminate the edge waves even when large-diameter leveling rolls having high rigidity are used.

EMBODIMENT FOR CARRYING OUT THE INVENTION

An embodiment of the present invention will now be described with reference to the accompanying drawings.

Figure 1:
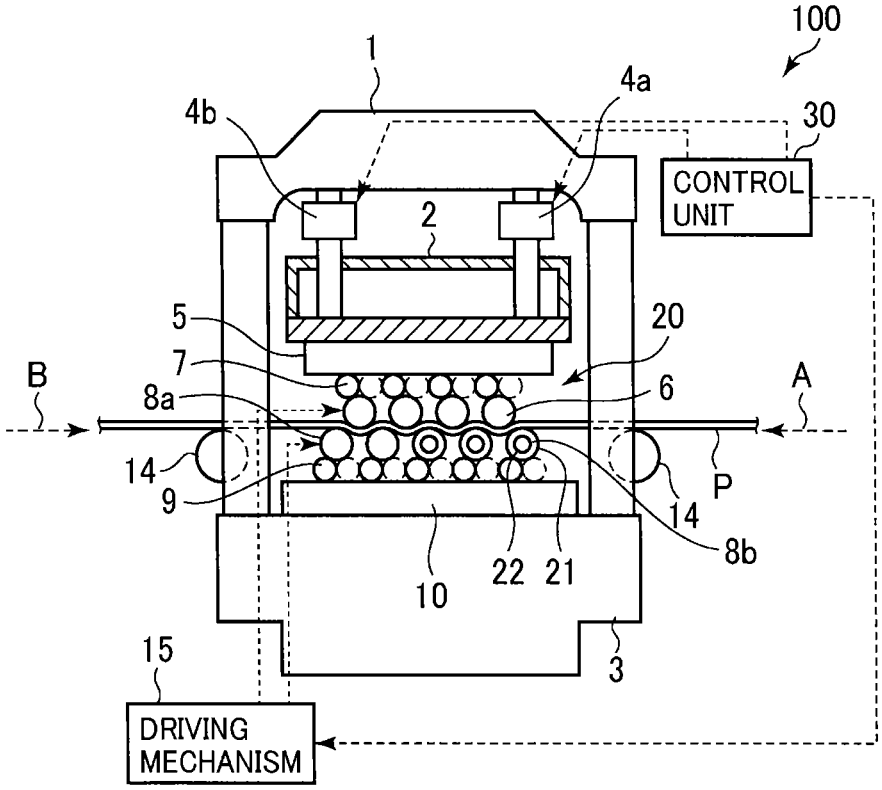
FIG. 1 is a side view of a roller leveler according to an embodiment of the present invention.
Figure 2:
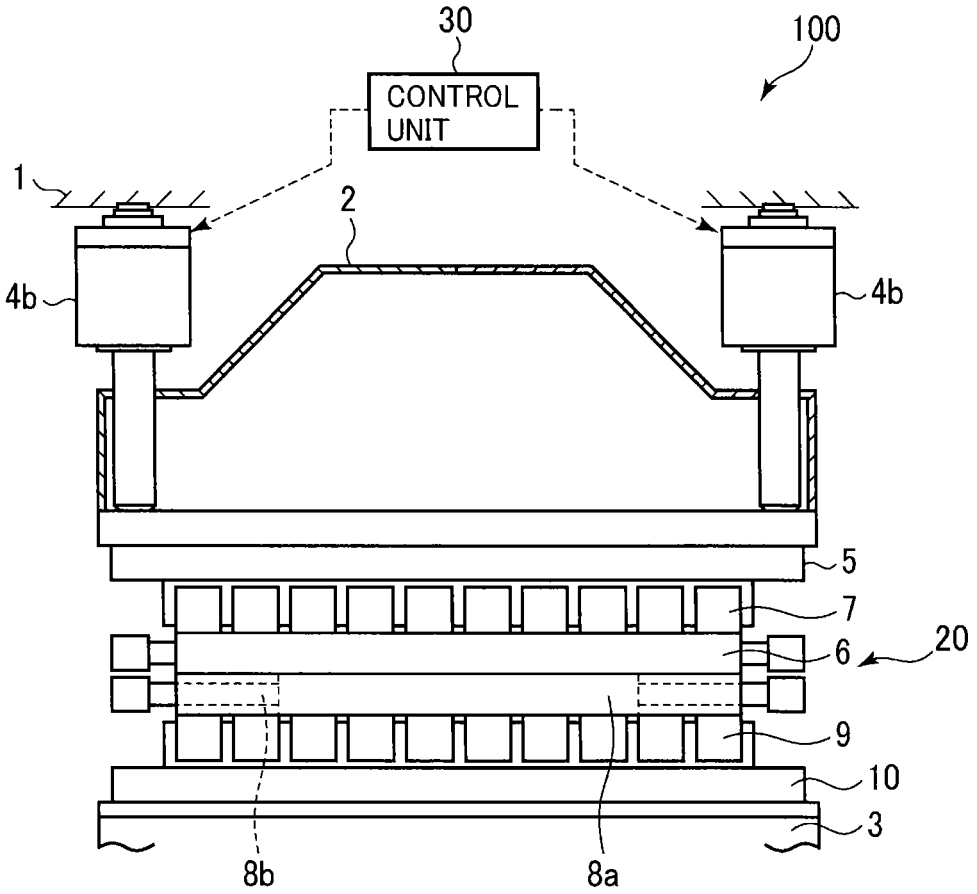
FIG. 2 is a front view of the roller leveler according to the embodiment of the present invention.
Figure 3:
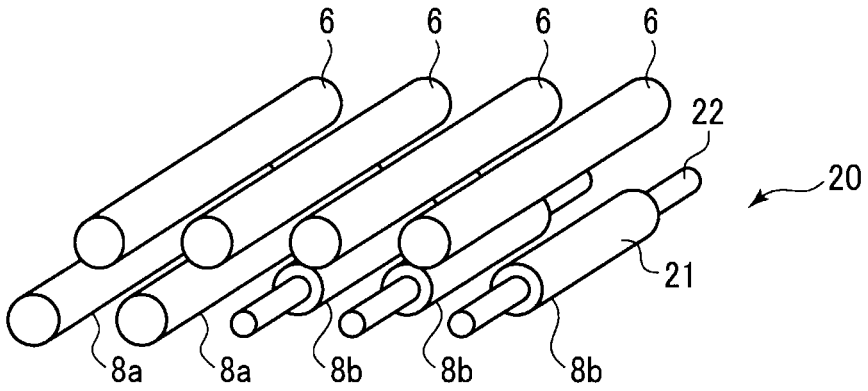
FIG. 3 is a perspective view of a leveling roll unit of the roller leveler according to the embodiment of the present invention.

FIG. 1 is a side view of a roller leveler according to an embodiment of the present invention, FIG. 2 is a front view thereof, and FIG. 3 is a perspective view of a leveling roll unit. A roller leveler 100 of the present embodiment includes a housing 1, an upper frame 2 provided inside the housing 1, and a lower frame 3 provided so as to support the housing 1. An upper roll frame 5 is hung under the upper frame 2 via upper roll gripping cylinders (not shown). Meanwhile, a lower roll frame 10 is provided above the lower frame 3. The upper frame 2 is vertically pushed and moved with the use of pushing cylinders (also referred to as "pressing cylinders") as described later and therefore, the upper frame 2 can be called "working frame". The working frame is not limited to the upper frame 2. A configuration may be adopted, in which the lower frame 3 is configured as the working frame and is vertically pushed and moved with the use of pushing cylinders provided under the lower frame 3.

Provided between the upper roll frame 5 and the lower roll frame 10 is a leveling roll unit 20 including a plurality of upper leveling rolls 6, a plurality of first lower leveling rolls 8*a*, and a plurality of second lower leveling rolls 8*b* that are arranged on upper and lower sides in a staggered manner so as to form a pass line of a plate P, which is a metal plate, such as a steel plate, between the upper leveling rolls 6 and the first and second lower leveling rolls 8*a* and 8*b*. In the leveling roll unit 20, the upper leveling rolls 6 are supported by the upper roll frame 5 under the upper roll frame 5, and the first lower leveling rolls 8*a* and the second lower leveling rolls 8*b* are supported by the lower roll frame 10 above the lower roll frame 10. Guide rolls 14 for guiding the plate P are provided on the upstream side and the downstream side of the leveling roll unit 20 with respect to the transfer direction, in which the plate P is transferred. The upper leveling rolls 6 and the first and second lower leveling rolls 8*a* and 8*b* are configured to be rotated forward and backward by a driving mechanism 15 and can perform leveling of the plate P while passing the plate P in the forward and backward directions, indicated by the direction A and the direction B in FIG. 1. Note that, in FIG. 1, the driving mechanism 15 is illustrated as if the driving mechanism 15 is connected to the whole of each of the rows of the upper leveling rolls 6 and the first and second lower leveling rolls 8*a* and 8*b* for the sake of convenience. In actuality, however, the driving mechanism 15 is configured to individually rotate the upper leveling rolls 6 and the first and second lower leveling rolls 8*a* and 8*b*.

Figure 4:
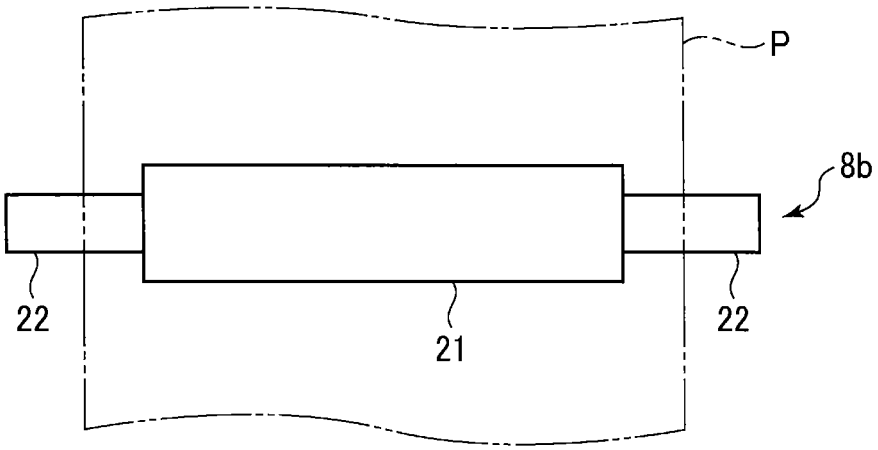
FIG. 4 is a diagram showing a structure of a lower leveling roll having a stepped structure, which is used in the roller leveler according to the embodiment of the present invention.

As shown in FIG. 3, the upper leveling rolls 6, the first lower leveling rolls 8*a*, and the second lower leveling rolls 8*b* are arranged in a staggered manner. The upper leveling rolls 6 and the first lower leveling rolls 8*a* have a straight form. On the other hand, each of the second lower leveling rolls 8*b* has a stepped structure, having a lateral center portion 21 with a large diameter and a lateral end portions 22 with a small diameter as shown in FIG. 4. The lateral center portion 21 corresponds to a center portion of the plate P with respect to the plate width direction. The lateral end portions 22 correspond to edge portions of the plate P with respect to the plate width direction. The length of the lateral center portion 21 and the length of the lateral end portions 22 are set according to the width and material of the plate P, heat-treatment conditions, etc.

The diameter of the lateral center portions of the second lower leveling rolls 8*b* is the same as the diameter of the upper leveling rolls 6 and the diameter of the first lower leveling rolls 8*a*.

In this embodiment, the number of the upper leveling rolls 6 is four, the number of the first lower leveling rolls 8*a*, which are disposed at one end side of the leveling roll unit 20, is two, and the number of the second lower leveling rolls 8*b*, which are disposed at the other end side of the leveling roll unit 20, is three.

A plurality of short-length upper backup rolls 7 for backing up the upper leveling rolls 6 are arranged along the axial direction of the upper leveling rolls 6 on the upper side of the upper leveling rolls 6 so as to be supported by the upper roll frame 5. A plurality of short-length lower backup rolls 9 for backing up the first and second lower leveling rolls 8*a* and 8*b* are arranged along the axial direction of the first and second lower leveling rolls 8*a* and 8*b* on the lower side of the first and second lower leveling rolls 8*a* and 8*b* so as to be supported by the lower roll frame 10.

Pressing cylinders (also referred to as "pushing cylinders" as described above) 4*a* and 4*b* for applying pressing force (hereinafter also referred to as "pushing force") to flatten the plate P are arranged at end portions of the leveling roll unit 20 with respect to the transfer direction of the plate P, between the housing 1 and the upper frame 2. The pressing cylinders 4*a* and 4*b*, each including two cylinders, are provided at two ends with respect to the width direction of the plate P (see FIG. 2, in which, however, only the pressing cylinders 4*b* are shown).

Note that, in this specification, the term "press" is intended to include not only a case where the pressure is applied downward as shown in FIG. 1 but also a case where the pressure is applied upward as explained later in the description of a modification. In other words, the term "press" can be replaced with the term "push" in this specification.

The pressing cylinders 4*a* and 4*b* are configured to press down the plate P via the upper roll frame 5, the upper backup rolls 7, and the upper leveling rolls 6 toward the first and second lower leveling rolls 8*a* and 8*b* provided on the lower roll frame 10 in a stationary manner. Note that the upper leveling rolls 6 may be provided in a stationary manner and the first and second lower leveling rolls 8*a* and 8*b* may be pressed by the pressing cylinders, that is, pressing is performed upward by the pushing cylinders.

When the plate P is transferred into the leveling roll unit 20 in the direction A, the pressing cylinder 4*a*-side is the entrance side and the plate P is inserted between the upper leveling rolls 6 and the second lower leveling rolls 8*b*. In this case, each of the pressing cylinders 4*a* functions as the entrance-side pressing cylinder and each of the pressing cylinders 4*b* functions as the discharge-side pressing cylinder. On the other hand, when the plate P is transferred into the leveling roll unit 20 in the direction B, the pressing cylinder 4*b*-side is the entrance side and the plate P is inserted between the upper leveling rolls 6 and the first lower leveling rolls 8*a*. In this case, each of the pressing cylinders 4*b* functions as the entrance-side pressing cylinder and each of the pressing cylinders 4*a* functions as the discharge-side pressing cylinder.

In this embodiment, a control unit 30 performs control of components of the roller leveler 100, that is, for example, control of the amount of penetration, which is also referred to as the pressing amount as described above, of the upper leveling rolls 6 via the pressing cylinders 4*a* and 4*b*, and control of the driving mechanism.

Next, description will be given of operation performed when the plate P is flattened by the roller leveler 100 configured as described above.

The plate P is transferred from the upstream side of the leveling roll unit 20 of the roller leveler 100 to the leveling roll unit 20, with the plate P being guided by the guide roll 14, and is flattened in the leveling roll unit 20.

The penetration depth (pressing amount) for the pressing cylinders 4*a* and 4*b* that is required to flatten the plate P according to the thickness etc. of the plate P is set in the control unit 30 and the flattening of the plate P is performed according to the set penetration depth (pressing amount). The pressing amount (penetration amount) is set so that the amount is the largest at the entrance-side end and decreases in the direction of the discharge side.

In a case where the thickness of the plate P to be flattened is in the range of 6 to 10 mm and the variation in yield stress of the plate P in the plate width direction is large ($\Delta\sigma=\sigma_{MAX}-\sigma_{MIN}>0.08\times\sigma_{MAX}$), when flattening is performed using leveling rolls with a large diameter of 360 mm or so, the amount of elongation is greater at the edge portion of the plate, with respect to the plate width direction, at the side, at which the yield stress is relatively small. For this reason, even when there is no edge wave before flattening the plate P, edge waves can occur during the flattening process. If there are edge waves, the degree of unevenness of the edge waves can further increase. Even when the variation in yield stress in the plate width direction of the plate P is small, edge waves can occur when the degree of rolling of the edge portions is greater than that of the center portion with respect to the plate width direction. It is difficult to flatten the plate, in which there are edge waves, with the use of leveling rolls with a large diameter of 360 mm or so.

In this embodiment, therefore, the second lower leveling rolls 8*b* having a stepped structure, each of which has the lateral center portion 21 with a large diameter and the lateral end portions 22 with a small diameter, are disposed at the pressing cylinder 4*a*-side. In a case, for example, where the variation in yield stress of the plate P in the plate width direction is large, more specifically, in a case where the plate P satisfies one of the following conditions (1) to (3), the plate P is transferred in the direction A and inserted between the upper leveling rolls 6 and the second lower leveling rolls 8*b* to flatten the plate P; the pressing cylinder 4*a*-side is the entrance side in this case. (1) The relation, $\Delta\sigma=\sigma_{MAX}-\sigma_{MIN}>0.08\times\sigma_{MAX}$ ($\Delta\sigma$ is approximately 50 MPa or more in a typical case), is satisfied, where the maximum value of yield stress in the plate width direction is $\sigma_{MAX}$ and the minimum value thereof is $\sigma_{MIN}$, and there is no edge wave. (2) The relation, $\Delta\sigma=\sigma_{MAX}-\sigma_{MIN}\leq 0.08\times\sigma_{MAX}$, is satisfied indicating that the variation in yield stress is small, and there are edge waves because, for example, the edge portions are strongly rolled as compared to the center portion in the plate width direction. (3) Both are satisfied. That is, the relation, $\Delta\sigma=\sigma_{MAX}-\sigma_{MIN}>0.08\times\sigma_{MAX}$, is satisfied and there are edge waves. Note that, in the case where the condition (1) is satisfied, since there is no edge wave, it is determined whether the pressing cylinder 4*a*-side or the pressing cylinder 4*b*-side is the entrance side, based on the information on the variation in yield stress of the plate P to be flattened, which information is obtained in advance.

Figure 5:
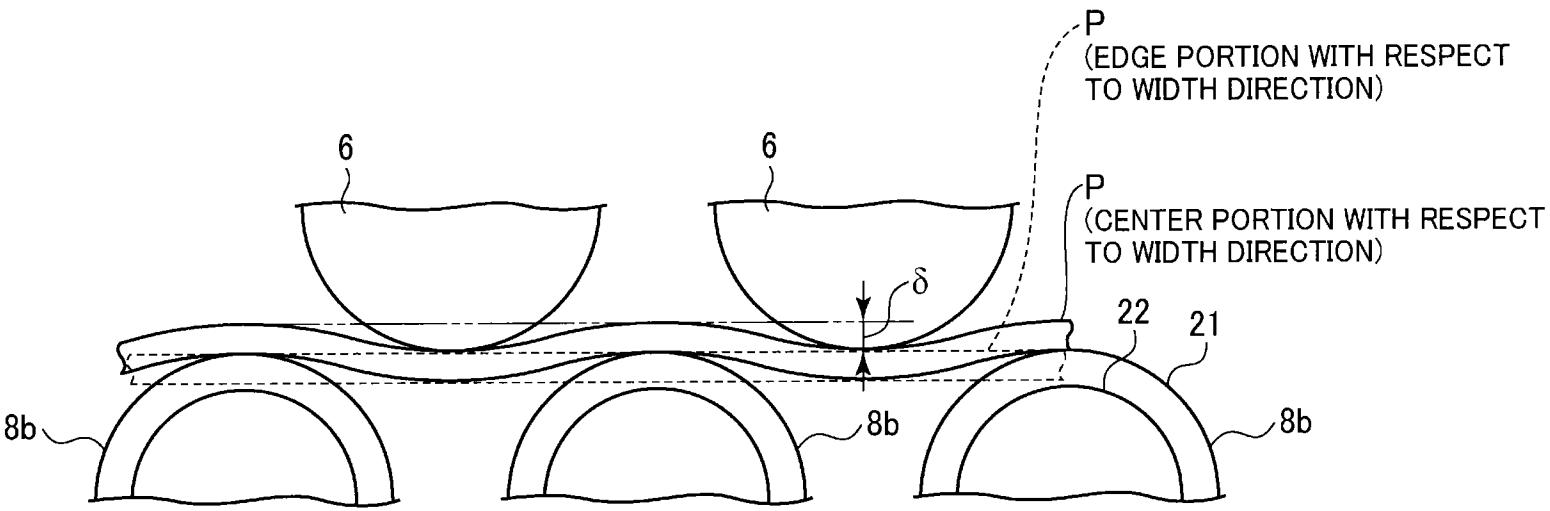
FIG. 5 is a diagram showing a difference in a path length of flattening processing of a plate P between a center portion with respect to a plate width direction and edge portions with respect to the plate width direction when the plate is flattened with the use of the lower leveling rolls having the stepped structure.

In the case where the plate P is pressed by the second lower leveling rolls 8*b*, as shown in FIG. 5, the plate P is pressed by the large-diameter, lateral center portions 21 as indicated by the solid line, resulting in the pressing amount (penetration amount) as indicated by 6 in FIG. 5, whereas the plate P is not pressed or pressed by a small pressing amount (penetration amount) by the small-diameter, lateral end portions 22 as indicated by the broken line. Consequently, the path length of flattening processing is longer at the center portion of the plate P with respect to the plate width direction as compared to the path lengths at the edge portions thereof. For this reason, it is possible to increase the elongation at the center portion of the plate P with respect to the plate width direction by using the second lower leveling rolls 8*b* at the entrance side, on which the pressing amount (penetration amount) is relatively large. After the elongation at the center portion with respect to the plate width direction is increased in this way, the plate P is evenly flattened by the upper leveling rolls 6 and the first lower leveling rolls 8*a*, which are straight rolls, at the latter stage portion of the leveling roll unit 20.

Accordingly, it is possible to increase the elongation at the center portion of the plate with respect to the plate width direction by reducing the pressing amount (penetration amount) at the edge portions of the plate with respect to the plate width direction, at which the yield stress is small and elongation is therefore easily caused, as compared to the pressing amount at the center portion of the plate with respect to the plate width direction in case that the variation in yield stress of the plate P in the plate width direction is large ($\Delta\sigma=\sigma_{MAX}-\sigma_{MIN}>0.08\times\sigma_{MAX}$). Thus, it is possible to suppress the occurrence of edge waves in the plate P during the flattening process even when large-diameter leveling rolls having high rigidity are used. Even when edge waves have already occurred in the plate P, it is possible to reduce the pressing amount (penetration amount) at the edge portions with respect to the plate width direction, at which there are edge waves, to reduce the elongation of the corresponding part of the plate P irrespective of the magnitude of the variation in yield stress, so that it is possible to eliminate the edge waves even when large-diameter leveling rolls having high rigidity are used.

Note that, as described above, the lengths of the lateral center portion 21 and the lateral end portions 22 of each of the second lower leveling rolls 8*b* having the stepped structure are set according to the width and material of the plate P to be flattened, heat-treatment conditions, etc. Specifically, since the position, at which the edge waves occur, depends on the width of the plate P, and the width of the edge waves that can occur depends on the material of the plate P and the heat-treatment conditions, it is necessary to set the lengths of the lateral center portion 21 and the lateral end portions 22 according to these conditions.

In the case where the variation in yield stress in the plate width direction of the plate P is small ($\Delta\sigma=\sigma_{MAX}-\sigma_{MIN}\leq 0.08\times\sigma_{MAX}$) and there is no edge wave, it is possible to perform flattening with the use of normal leveling rolls. Such a plate P is therefore transferred into the leveling roll unit 20, in which the straight, first lower leveling rolls 8*a* are disposed at the pressing cylinder 4*b* side, which is the entrance side, and flattening is performed so as to make the elongation of the center portion of the plate with respect to the plate width direction and the elongation of the edge portions thereof almost equal to each other. In this case, when the plate P is being transferred in the direction A, the plate P is passed through the leveling roll unit 20 without processing while the upper leveling rolls 6 are kept raised, and then the transfer direction of the plate P is changed to the direction B and the plate P is transferred into the leveling roll unit 20.

In this way, it is possible to perform an ordinary flattening process with the use of the straight leveling rolls, with which it is possible to obtain even elongation between the lateral center portion and the lateral end portions in the entrance side area, in which the pressing amount (penetration amount) is large. While the second lower leveling rolls 8*b* having the stepped structure are disposed at the latter stage portion, the pressing amount (penetration amount) is small at the latter stage portion and it is therefore possible to keep the effect small.

As described above, it is possible to perform flattening by a single leveler irrespective of whether the variation in yield stress in the plate width direction is large or small, by changing the side, on which the plate P is transferred into the leveling roll unit 20.

Next, another embodiment will be described.

In the case of the above-described second lower leveling rolls 8*b*, it is necessary to change the width of the lateral center portion 21 according to the width and material of the plate P, heat-treatment conditions, etc., which necessitates to prepare the second lower leveling rolls 8*b* corresponding to varieties of plates P and perform replacement of the second lower leveling rolls 8*b*, which may be very troublesome.

Figure 6:
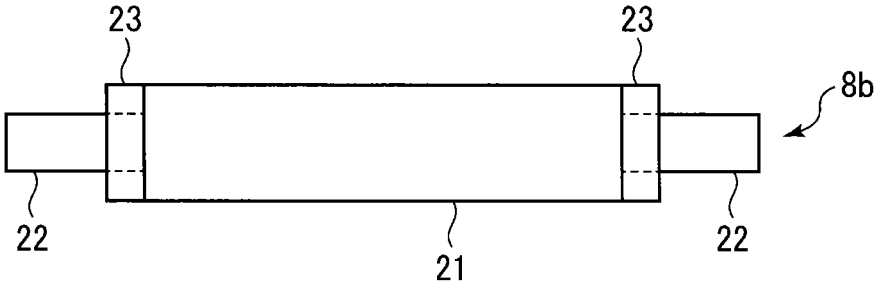
FIG. 6 is a diagram showing another example of the structure of the lower leveling roll having the stepped structure.

In this embodiment, therefore, the width of the lateral center portion 21 of each of the second lower leveling rolls 8*b* is variable so as to make it possible to deal with the change in the width and material of the plate P, the heat-treatment conditions, etc. Specifically, as shown in FIG. 6, each of the second lower leveling rolls 8*b* is configured to be able to be fitted with rings 23 having the diameter the same as that of the lateral center portion 21, so that it is made virtually possible to adjust the width of the lateral center portion 21. It is made possible to deal with varieties of plates by preparing in advance a plurality of rings 23 having different widths.

The present invention is not limited to the above embodiments and various modifications can be made. For example, while the above embodiment illustrates an example, in which part of the lower leveling rolls have the stepped structure, the upper leveling rolls may have the stepped structure, or alternatively, the upper and lower leveling rolls may have the stepped structure. From the viewpoint of the ease in changing the rolls, however, it is preferable that the lower leveling rolls have the stepped structure. While an example has been illustrated, in which the three lower leveling rolls at one end of the leveling roll unit have the stepped structure, the number of the leveling rolls having the stepped structure may be at least one and in the case of plural stepped rolls, the arrangement thereof may be determined as desired, as long as it is possible to increase the elongation of the center portion of the plate with respect to the plate width direction. When two or more lower leveling rolls from one end of the leveling roll unit have the stepped structure, the elongation of the center portion of the plate with respect to the plate width direction is effectively increased while keeping the ease of changing the rolls. The leveling rolls (both of or one of the upper leveling rolls and the lower leveling rolls) at both ends of the leveling roll unit may have the stepped structure when it is intended to flatten such plates only that have large variation in yield stress.

While the above embodiment illustrates an example of a roller leveler, in which the number of leveling rolls arranged on upper and lower sides is nine in total, the number of the leveling rolls is not limited to this number. While the above embodiment shows a case where a plate is flattened by pressing the upper leveling rolls by the pressing cylinders (that is, by pushing downward with the use of the pushing cylinders), a plate may be flattened by pressing the lower leveling rolls by the pressing cylinders (that is, by pushing upward with the use of the pushing cylinders).

DESCRIPTION OF REFERENCE NUMERALS

1; housing
2; upper frame (working frame)
3; lower frame
4*a*, 4*b*; pressing cylinder (pushing cylinder)
5; upper roll frame
6; upper leveling roll
7; upper backup roll
8*a*; first lower leveling roll
8*b*; second lower leveling roll
9; lower backup roll
10; lower roll frame
15; driving mechanism
20; leveling roll unit
21; lateral center portion
22; lateral end portion
23; ring
30; control unit
100; roller leveler
P; plate (material to be flattened)

The invention claimed is:

1. A roller leveler for flattening a plate, comprising:

a leveling roll unit including a plurality of leveling rolls arranged on upper and lower sides of a pass line in a staggered manner and configured to rotate so as to pass the plate while flattening the plate sandwiched therebetween;

a pushing cylinder provided at each of an entrance side and a discharge side of the leveling roll unit, at which the plate enters and is discharged, respectively, and configured to press the plate via the leveling rolls:

a driving mechanism configured to rotate the leveling rolls to pass the plate; and said plurality of leveling rolls comprising 1) two or more first rollers each having a stepped structure comprising, a lateral center portion with a uniform diameter D1 extending along a longitudinal axis of the first roller corresponding to a center portion of the plate with respect to a plate width direction, and a lateral end portion with a uniform diameter D2 smaller than D1 extending from the lateral center portion along said longitudinal axis of the first roller to an end of the first roller corresponding to an edge portion of the plate with respect to the plate width direction; and 2) two or more second rollers each having a straight form comprising a uniform diameter D3 extending from a center thereof to an outside edge corresponding to said edge portion of the plate, wherein the two or more first rollers each having the stepped structure are disposed sequentially on a first side of the leveling roll unit without any of the second rollers in between, the two or more second rollers each having the straight form only are disposed on a second side of the leveling roll unit without any of the first rollers in between, and when the plate is flattened, a pressed amount at the center portion of the plate pressed between central sections of both 1) said two or more first rollers each having the stepped structure and 2) said two or more second rollers is greater than a pressed amount at the edge portion of the plate having only been pressed by said two or more second rollers each having the straight form only.

2. The roller leveler according to claim 1, wherein the plurality of leveling rolls include a plurality of upper leveling rolls that are arranged above the pass line and a plurality of lower leveling rolls that are arranged below the pass line, wherein at least one of the lower leveling rolls has the stepped structure.

3. The roller leveler according to claim 2, wherein two or more of the lower leveling rolls from one end of the leveling roll unit have the stepped structure.

4. The roller leveler according to claim 1, wherein the first side comprises the entrance side and flattening of the plate is performed with the first side being the entrance side when a variation $\Delta\sigma$ in yield stress in the plate in the plate width direction satisfies a relation, $\Delta\sigma>0.08\times\sigma_{MAX}$, and/or there are edge waves in the plate, and flattening of the plate is performed with the second side being the entrance side when a relation, $\Delta\sigma$ is less than or equal to $0.08\times\sigma_{MAX}$ is satisfied and there is no edge wave in the plate, wherein $\Delta\sigma$ is equal to $\sigma_{MAX}-\sigma_{MIN}$, $\sigma_{MAX}$ is a maximum value of yield stress in the plate width direction, and $\sigma_{MIN}$ is a minimum value of yield stress in the plate width direction.

5. The roller leveler according to claim 1, wherein a length of the lateral center portion of the leveling roll having the stepped structure and a length of the lateral end portion thereof are set according to a width and a material of the plate to be flattened, and a heat-treatment condition of the plate.

6. The roller leveler according to claim 1, wherein the leveling roll having the stepped structure is configured so that the lateral end portion thereof is capable of being fitted with a ring having a diameter the same as that of the lateral center portion thereof so that length of the lateral center portion thereof is adjustable with the use of the ring.

7. A plate flattening method of flattening a plate with the use of a roller leveler having a leveling roll unit inducing a plurality of leveling rolls arranged on upper and lower sides of a pass line in a staggered manner and configured to rotate so as to pass the plate while flattening the plate sandwiched therebetween, a pushing cylinder provided at each of an entrance side and a discharge side of the leveling roll unit, at which the plate enters and is discharged, respectively, and configured to press the plate via the leveling rolls, a driving mechanism configured to rotate the leveling rolls to pass the plate, with said plurality of leveling rolls including 1) two or more first rollers each having a stepped structure comprising a lateral center portion with a uniform diameter D1 extending along a longitudinal axis of the first roller corresponding to a center portion of the plate with respect to a plate width direction, and a lateral end portion with a uniform diameter D2 smaller than D1 extending from the lateral center portion along said longitudinal axis of the first roller to an end of the first roller corresponding to an edge portion of the plate with respect to the plate width direction; and 2 two or more second rollers each having a straight form comprising a uniform diameter D3 extending from a center thereof to an outside edge corresponding to said edge portion of the plate, the two or more first rollers each having the stepped structure are disposed sequentially on a first side of the leveling roll unit without any of the second rollers in between, and the two or more second rollers each having the straight form only are disposed on a second side of the leveling roll unit without any of the first rollers in between, the plate flattening method comprising:

sandwiching the plate between the plurality of leveling rolls including said two or more first rollers having the stepped structure and said two or more second rollers each having a straight form; and rotating the leveling rolls while the pushing cylinder presses the plate via the leveling rolls to pass and flatten the plate; and flattening the plate by applying a pressing amount at the center portion of the plate pressed between central sections of both 1) said two or more first rollers each having the stepped structure and 2) said two or more second rollers which is greater than a pressing amount at the edge portion of the plate having only been pressed by said two or more second rollers each having, the straight form only.

8. The plate flattening method according to claim 7, wherein the plurality of leveling rolls include a plurality of upper leveling rolls that are arranged above the pass line and a plurality of lower leveling rolls that are arranged below the pass line, wherein at least one of the lower leveling rolls has the stepped structure.

9. The plate flattening method according to claim 8, wherein two or more of the lower leveling rolls from one end of the leveling roll unit have the stepped structure.

10. The plate flattening method according to claim 7, wherein when a variation $\Delta\sigma$ in yield stress in the plate in the plate width direction satisfies a relation, $\Delta\sigma>0.08\times\sigma_{MAX}$, and/or there are edge waves in the plate, flattening of the plate is performed with the first side being the entrance side so that the pressing amount at the center portion of the plate with respect to the plate width direction is greater than the pressing amount at the edge portion of the plate with respect to the plate width direction to suppress occurrence of the edge waves at the edge portion of the plate with respect to the plate width direction and/or eliminate the edge waves present at the edge portion of the plate with respect to the plate width direction with the use of the leveling roll or rolls having the stepped structure, and, when a relation, $\Delta\sigma \leq 0.08 \times \sigma_{MAX}$, is satisfied and there is no edge wave in the plate, flattening of the plate is performed with the second side being the entrance side so that the elongation of the center portion of the plate with respect to the plate width direction and the elongation of the edge portion of the plate with respect to the plate width direction are almost equal to each other, wherein $\Delta\sigma$ is equal to $\sigma_{MAX}-\sigma_{MIN}$, $\sigma_{MAX}$ is a maximum value of yield stress in the plate width direction, and $\sigma_{MIN}$ is a minimum value of yield stress in the plate width direction.

11. The plate flattening method according to claim 7, wherein length of the lateral center portion of the leveling roll having the stepped structure and length of the lateral end portion thereof are set according to width and material of the plate to be flattened, and a heat-treatment condition of the plate.

12. The plate flattening method according to claim 7, wherein the leveling roll having the stepped structure is configured so that the lateral end portion thereof is capable of being fitted with a ring having a diameter the same as that of the lateral center portion thereof so that length of the lateral center portion thereof is adjustable with the use of the ring according to width and material of the plate to be flattened, and a heat-treatment condition of the plate.

* * * * *